US007713077B1

(12) United States Patent
McGowan et al.

(10) Patent No.: US 7,713,077 B1
(45) Date of Patent: May 11, 2010

(54) INTERPOSER CONNECTOR

(75) Inventors: Daniel B. McGowan, Naperville, IL (US); Kenneth M. Stiles, Rochester, MN (US); Kenneth T. Stead, Aurora, IL (US); Arvind Patel, Naperville, IL (US); Michael S. Bean, St. Charles, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/393,375

(22) Filed: Feb. 26, 2009

(51) Int. Cl.
*H01R 13/64* (2006.01)

(52) U.S. Cl. ..... 439/249

(58) Field of Classification Search ..... 439/248, 439/247, 310, 259
See application file for complete search history.

(56) References Cited

U.S. PATENT DOCUMENTS 4,392,700 A * 7/1983 Showman et al. ..... 439/260
5,073,125 A * 12/1991 Hashiguchi et al. ..... 439/310
5,385,480 A * 1/1995 Hoffman ..... 439/310

* cited by examiner

*Primary Examiner*—Phuong K Dinh
(74) *Attorney, Agent, or Firm*—Stephen L. Sheldon

(57) ABSTRACT

An interposer connector is provided that is suitable for translatable connection between a first and second connector. The interposer connector includes a housing with a face that includes an opening and a terminal positioned in the opening. The terminal is configured to pivot about the opening so that when the interposer is caused to couple the first and second connector, the terminal may translate along a first plane to account for misalignment in a first direction between the first and second connector. The housing may further be configured to allow the terminal to translate in a second plane that is substantially perpendicular to the first plane so as to account for misalignment in a second direction.

22 Claims, 10 Drawing Sheets

INTERPOSER CONNECTOR

BACKGROUND OF THE INVENTION

The present invention generally relates to interposer connectors having a translatable component for multiple contact mating.

In general, an interposer connector facilitates the mating of connector assemblies by bridging the gap between two different sides of a connector assembly. An interposer can also be translatable so as to allow the interposer to move from an unmated positioned to a mated position. Prior to being in the mated position, the interposer connector is in contact with a first side of the connector assembly. Once the interposer connector is translated to the mated position, the interposer connector remains in contact with the first side of the connector assembly but is also brought into contact with a second side of the connector assembly, thus bridging the two sides of the connector assembly. Unmating can be achieved by translation in the opposite direction. Both electrical power and signal terminals can be provided by interposer connectors.

While existing connector assemblies have provided some acceptable features and functions, certain aspects of existing designs make the manufacture of such connector assemblies more costly or difficult than desired. Furthermore, systems and methods of improving the reliability or ease of assembly would be appreciated. Accordingly, improvements in the design and construction of a connector assembly would be appreciated by certain individuals.

SUMMARY OF THE INVENTION

An interposer assembly may be provided to act as a bridge between a first connector and a second connector that are spaced apart. A terminal may be positioned on the interposer assembly for mating engagement with a corresponding terminal on the first and second connector. The interposer assembly includes a first housing with a cavity and a terminal housing that is slidably positioned in the cavity, the terminal housing being slidable along a first axis. The terminal is pivotally secured to the terminal housing and also pivotally secured to the first housing and further extends beyond at least one of the terminal housing and the first housing to an unsupported end. Sliding the terminal housing with respect to the first housing along the first axis causes the terminal to pivot with respect to the first housing and the terminal housing, thus modifying the position of the unsupported end about the closest pivot point. In an embodiment, the terminal may be slidably supported within the first housing and the terminal housing so as to be translatable along a second axis that is perpendicular to the first axis. In an embodiment, a plurality of terminals may be positioned and supported by the first housing and the terminal housing in a pivotal and/or slidable manner. In an embodiment, the terminal(s) may be a blade-shaped power terminal.

In an embodiment, an interposer assembly may be supported by a movable mounting bracket. The mounting bracket is configured to be translated so as to move the interposer assembly between an unmated and a mated position. The mounting bracket may be attached to a movable member such as a lever or a cam. The interposer connector module may include a blade-type terminal that extends from two opposing sides of the interposer connector module. The terminal may be configured to be pivoted about a first plane and a second plane that are substantially orthogonal to each other. The interposer connector may further include at least one terminal position assurance member configured to cause the interposer connector to become aligned with a receiving connector when the interposer connector module is translated from an unmated to a mated position. In addition, a plurality of signal terminals may be supported by the interposer assembly and coupled to flexible signal paths and be configured to engage corresponding signal terminals in the receiving connector when the interposer is translated to the mated position.

DETAILED DESCRIPTION

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner, including employing various features disclosed herein in combinations that might not be explicitly disclosed herein.

One common issue with coupling two components supported by two different circuit boards is that the mounting features on both circuit boards will have tolerances, the mounting support for the circuit boards will have tolerances, the position of any components on the circuit board will have a tolerance and the dimensions of the two components will have tolerances. The stack-up of these tolerances can be significant and therefore substantial effort and money has historically been exerted to control the tolerances so that the components can be coupled together. The issue is particularly problematic when there is a desire to have the connection of the two components made by translating a lever that supports an interposing connector. A connector with one side coupled to only flexible components could be used but generally such connectors are less ideally suited to applications that distribute high power. In addition, if the interposing connector includes a number of terminals, it is sometimes desirable to allow each terminal to translate separately so as to account for potential variations in skew that can occur between to such connectors. Existing connectors have been determined to be insufficient to address all these issues, thus an improved interposer is disclosed herein. It should be noted that depending on the needs of the system, various features disclosed herein may be included or omitted from an interposer assembly so as to provide a desired functionality. Thus, an interposer assembly may include one or more of the depicted features and is not limited to the particular embodiments depicted herein unless otherwise noted.

Figure 1:
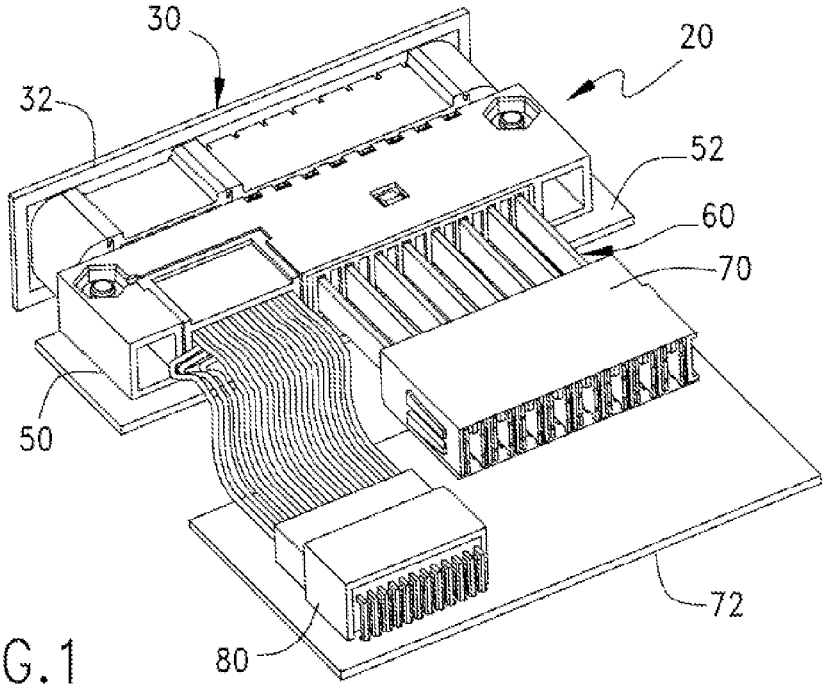
FIG. 1 is a perspective view of an embodiment of an interposer and connector assembly in a mated position.

FIG. 1 illustrates an embodiment of an interposer and connector assembly generally designated 20. The interposer and connector assembly 20 has a connector assembly 30, an interposer assembly 50, a power connector 70 and a signal header 80. The connector assembly 30 is shown connected to a circuit board 32. Connector assembly 30 can function for example, as a backplane connector. The interposer assembly 50 is shown supported by a bracket 52, which in an embodiment may be translatable, and includes terminals 60. The power connector 70 and the signal header 80 are shown connected to a circuit board 72. Circuit board 32 and circuit board 72 may be fixed in a spaced apart position and, while shown in a generally perpendicular orientation to each other, may be in some other orientation to each other. Thus, the power connector 70 and the connector assembly 30 are examples of a first and second connector. It should be noted that conventional materials may be used to construct the housing and terminals. The interposer connector, for example, may be formed of a desirable industry standard dielectric material such as plastic and may be a high temperature polymer. The terminals 60, as a further example, can comprise any industry standard conductive material such as a copper alloy or some other desirable metal and may include one or more plating.

Figure 2:
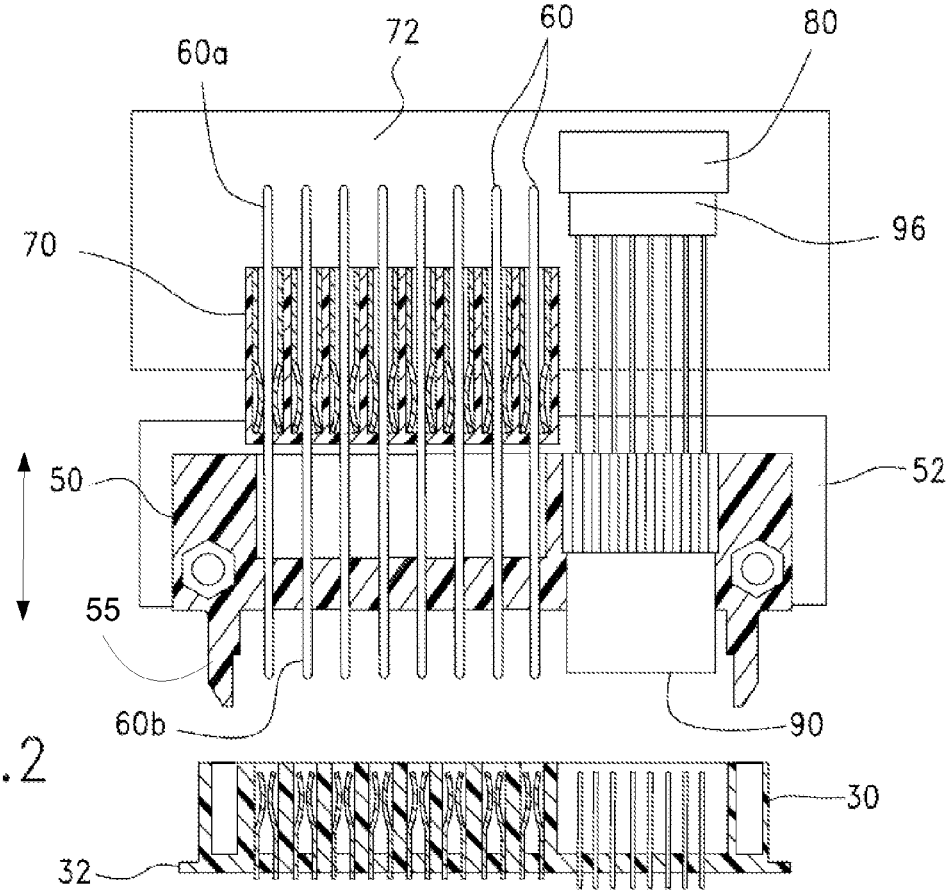
FIG. 2 is a cut-away top plan view of the interposer and connector assembly of FIG. 1 in an unmated position.
Figure 3:
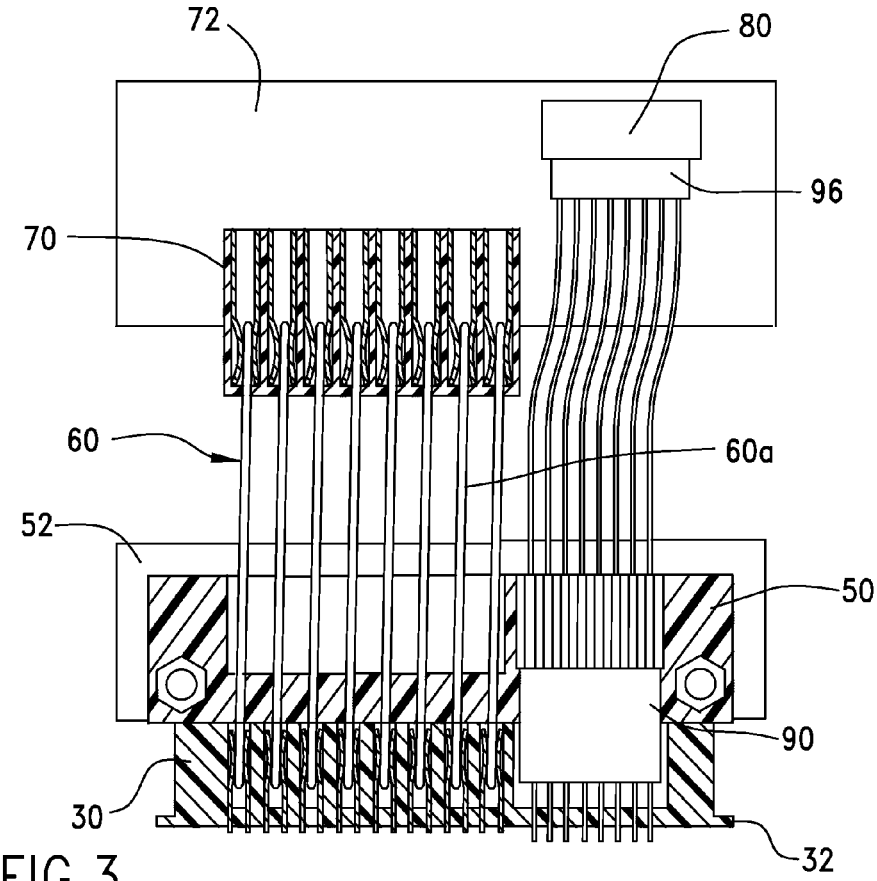
FIG. 3 is a cut-away top plan view of the interposer and connector assembly of FIG. 1 in the mated position.

As illustrated in FIG. 2, the interposer and connector assembly 20 is in an unmated position when the interposer assembly 50 is coupled to the power connector 70 but is not in electrical contact with the connector assembly 30. FIG. 3 illustrates the interposer and connector assembly 20 in the mated position wherein the interposer assembly 50 couples the power connector 70 with the connector assembly 30. Translation of the interposer assembly 50 into the mated position allows second extension 60*b* to engage terminals in connector assembly 30 while first extension 60*a* retains electrical connection with terminals in power connector 70. As depicted, flexible conductive elements, which may be cables or flex cable or the like, extend between connector 96 and interposer assembly 50 and help couple terminals in signal header 80 to terminals in connector assembly 30. The flexible conductive paths may be configured for higher speed signal applications with increased densities as compared to the configuration of the terminals 60. It should be noted, however, that terminals 60 may be used for power, signals, or some combination thereof.

As depicted, the interposer assembly 50 has an interposer housing 54 attached to bracket 52 by two bolts 53*a*. Alternatively, the bracket 52 may support the interposer housing 54 using any desirable method, such as rivets, solder or a suitable adhesive for example. Mating components are provided for aligning and joining the interposer module 50 to the connector assembly 30. As depicted, interposer housing 54 includes guides 55, and the connector assembly 30 can include complementary channels or guides configured to receive guides 55. Guides 55 are examples of orientation members that act to ensure interposer assembly 50 is properly aligned with the connector assembly 30 so that the terminals 60 can engage terminals in the connector assembly 30. As can be appreciated, the guide 55 may cause the position of interposer assembly 30 to shift, thus the support system for the interposer assembly 50 preferably allows such shifting. Alternatively, the supporting structure, such as the bracket 52, for interposer assembly 30 can be configured to flex so that it becomes aligned with connector assembly 30 during translation toward the mating position.

As depicted, a plurality of terminals 60 are mounted within the interposer assembly 50 and each terminal may exhibit floating characteristics, as will be discussed below. The terminal 60, which may be configured as a power blade, extends outward from two sides of the terminal housing 56 to define the first extension 60*a* and the second extension 60*b*. As the first extension 60*a* can limit how far the interposer connector can be translated, it can be beneficial to have the first extensions 60*a* longer than the second extension 60*b*. The first extension 60*a* is sized such that they pass through the power connector 70 in the unmated position (FIG. 2) but still maintain electrical contact with the power connector 70 in the mated position (FIG. 3). The second extension 60*b* is sized to make electrical contact with the connector assembly 30 in the mated position and to break electrical contact with the connector assembly 30 in the unmated position. In an embodiment, the first extensions 60*a* may extend external of the interposer housing 54 a first distance that is at least twice a second distance that the second extension extends external of the housing 54. In another embodiment, the first distance may be at least three times the second distance.

As depicted, a signal module 90 is seated within a signal channel 92 in the interposer housing 54 and a terminal position assurance member 63 secures the signal module 90 within the interposer housing 54. Signal wires 94, which may be configured to provide high data rates of 2 or more Gbps per channel, electrically connect signal terminals 91 in the signal module 90 to terminals a housing 95 of signal connector 96. The depicted signal module 90 also includes a signal module housing 93. As noted above, conventions materials may be used, such as high temperature polymers for the housings and copper alloys for the terminals. It should be noted that while conductive wires are depicted, in an embodiment other signal passing mediums such as optical cables could also be positioned in the signal module. Thus, unless otherwise noted, the type of signal module provided is not intended to be limiting.

It should be noted that the illustrated signal module housing 93 provides a single housing for all the signal terminals 91. Alternatively, one or more of rows or columns of signal module terminals 91 can be positioned in separate signal module housing. In that regard, it should be noted that the depicted configuration of terminals 60 on one side and terminals 91 on the other side is merely exemplary because alternative embodiments may intermix terminals 60 and 91 along the interposer housing 54. If terminals are used for higher power applications, air channels 62 may be provided to provide air flow at the mating interface between the interposer assembly 50 and the connector assembly 30.

Figure 6:
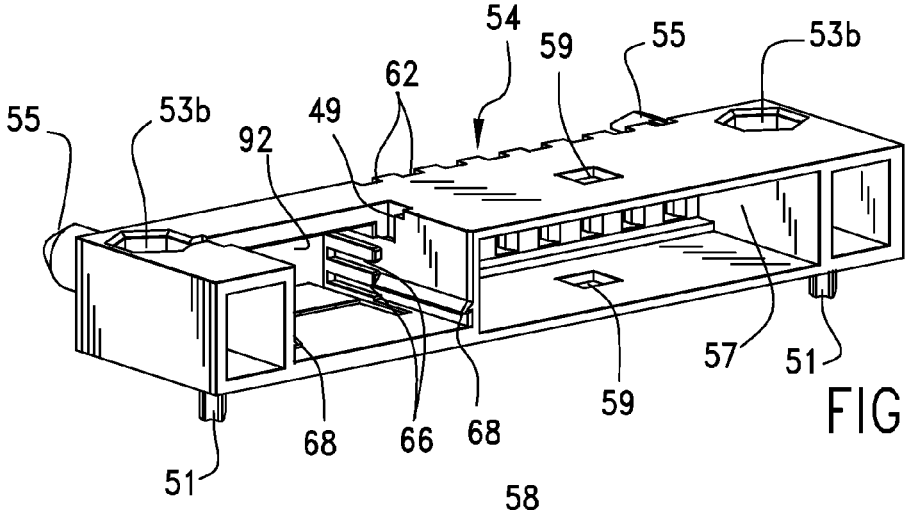
FIG. 6 is a perspective view of the interposer housing of the interposer assembly of FIG. 4.

As illustrated in FIG. 6, the interposer housing 54 includes guide posts 51 that engage a support, such as the bracket 52. Bolt holes 53*b* are adapted to receive bolts 53*a*, thereby attaching the interposer housing 54 to the bracket 52. Alternatively, any known fastener could be used to attach the interposer housing to the bracket, such as screws, rivets or adhesive for example. As noted above, to account for possible misalignment it may be desirable to support the interposer housing in an adjustable manner.

Figure 7:
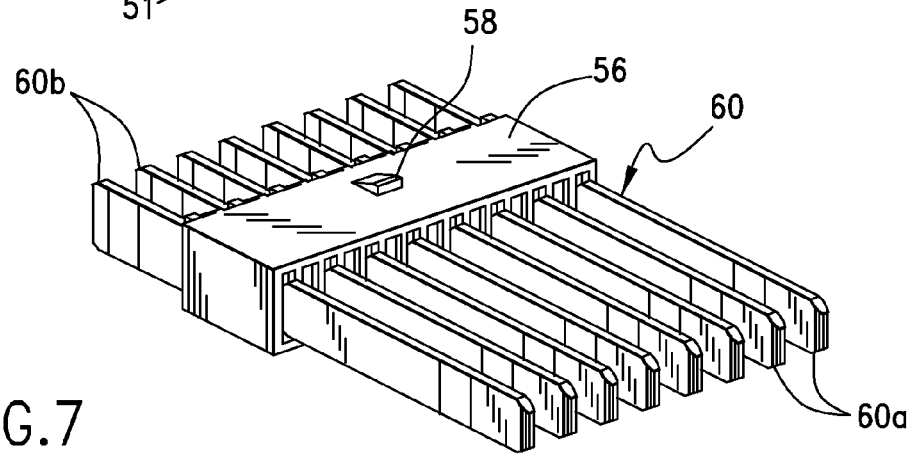
FIG. 7 is a perspective view of a terminal housing of the interposer assembly of FIG. 4 with terminals installed.

A terminal housing cavity 57 is adapted to receive the terminal housing 56 (see FIG. 7). With reference to the floating aspect noted herein, the terminal housing cavity 57 and the terminal housing 56 are sized, shaped and oriented such that the terminal housing 56 can translate laterally (e.g., from side to side) up to a predetermined amount within the blade housing cavity 57 so as to provide an adjustable positioning of the terminals 60.

In particular, the terminal housing cavity 57 has an internal cross-sectional perimeter greater than the external perimeter of the terminal housing 56. The resulting differences in length and height of the respective perimeters allows terminal housing 56 to translate with respect to terminal housing cavity 57. Placement of the terminal housing 56 within the terminal housing cavity 57 can be secured by a latching arrangement. As depicted, for example, a latch opening 59 is configured to receive a latch 58 such that when the latch 58 engages the latch openings 59, the latch 58 prevents the terminal housing 56 from being removed from the terminals housing cavity 57 while allowing the terminal housing 56 to translate from side-to-side within the terminals housing cavity 57. In an embodiment, the latch 58 and latch opening 59 may be sized so that the latch 58 limits the lateral movement, however, in another embodiment the size of the terminal housing cavity 57 and the terminal housing 56 will limit the lateral movement. Latches 58 and latch apertures 59 are illustrative of interference elements that are suitable for securing the terminal housing 56 within the terminal housing cavity 57. Other elements can be substituted and, for example, a projecting element can be provided in place of the latch opening so that the projecting element extends into the terminal housing cavity while a matching indent can be provided in the terminal housing 56. Thus latch and latch opening are representative of retaining features that may be configured to control or allow movement of the terminal housing 56 within the terminal housing cavity and the shape, quantity and location of the retaining feature can vary.

Figure 8:
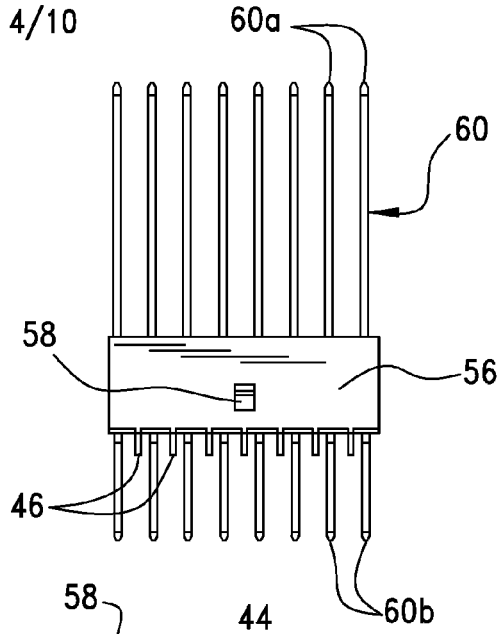
FIG. 8 is a top plan view of terminal housing and terminals depicted in FIG. 8.
Figure 9:
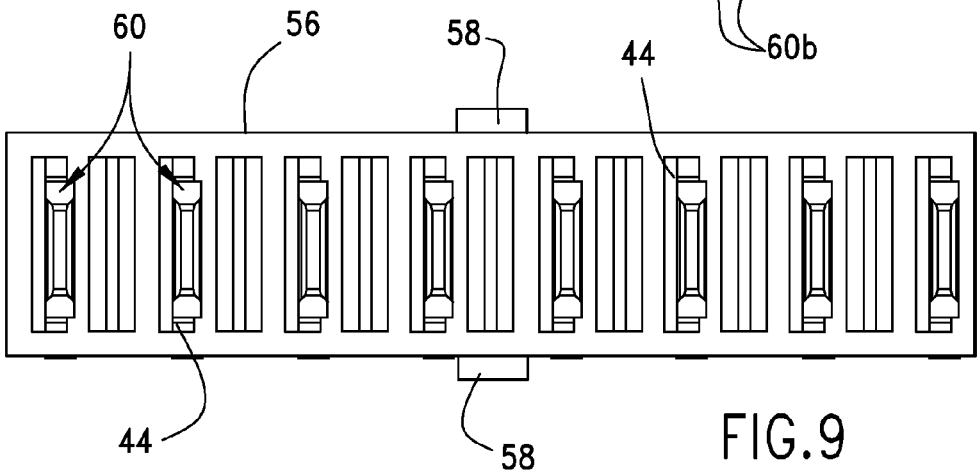
FIG. 9 is a front elevation view of the terminal housing depicted in FIG. 7.

As further illustrated in FIGS. 7, 8 and 9, terminal housing 56 may include one or more lead-in 46. The lead-in 46 may be sized to engage and/or to be inserted into an opening in an opposing side wall of the interposer housing 54 as the terminal housing 56 is inserted into the interposer housing 54. A terminal channels 44 may be sized to allow the terminals 60 to pass through and to allow for float of the terminal 60.

Figure 10:
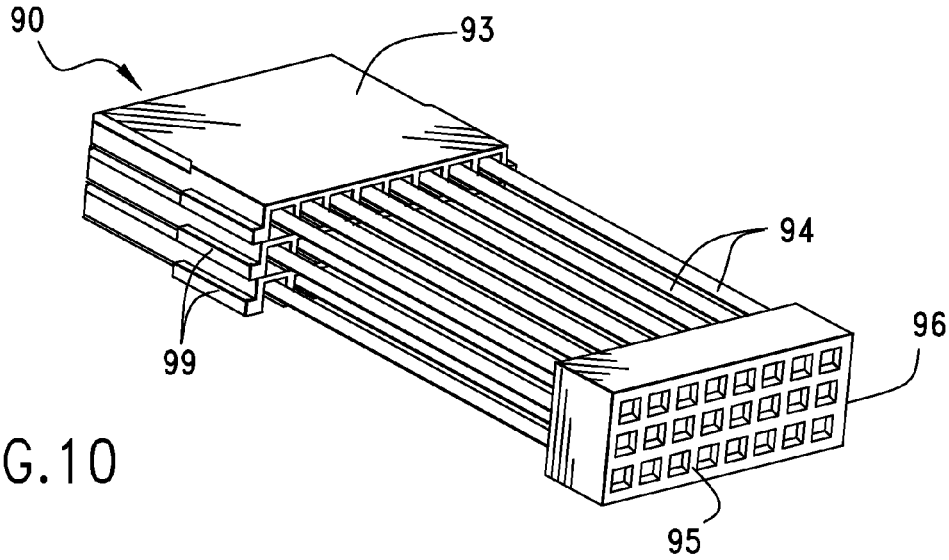
FIG. 10 is a perspective view of a signal module component of the interposer assembly of FIG. 4.

The signal channel 92 is adapted to receive the signal module 90 (FIG. 10) and the terminal position assurance member 63. The signal module housing 93 can have guide members 99 as seen in FIG. 10. The guide members 99 are adapted to engage and be slidably received within guide channels 66 in the interposer housing 54 as seen in FIG. 6. The guide members 99 and the guide channels 66 provide guidance during pass-through sliding of the signal module 90 into the signal channel 92.

Figure 4:
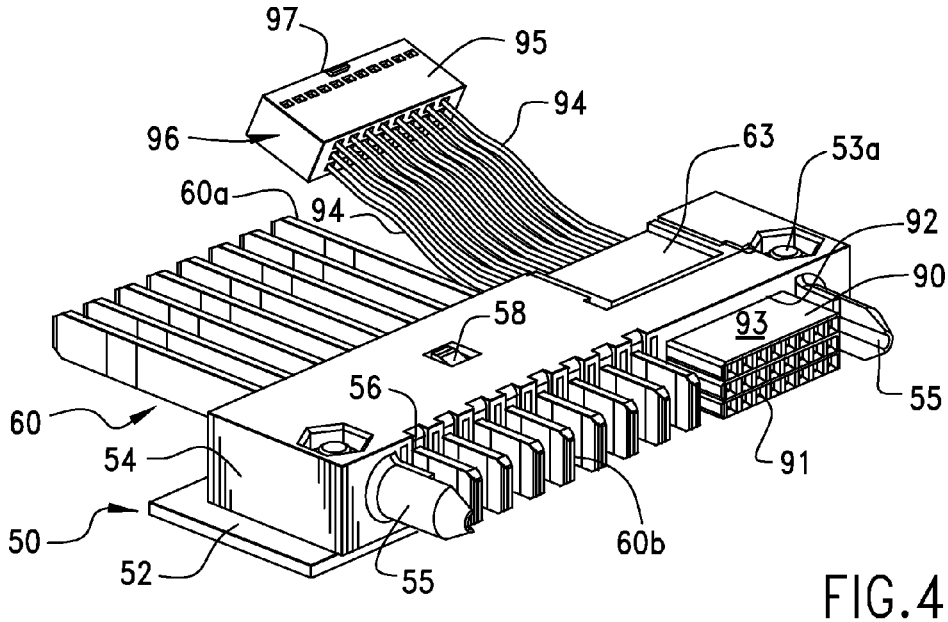
FIG. 4 is a perspective view of an embodiment of a supported interposer assembly.

The terminal position assurance member 63 can be generally U-shaped and can have latch members 64 that are deflectable to facilitate snap-in assembly to the interposer housing 54 in the illustrated embodiment. In an embodiment, a pair of deflectable latch members can be provided, each being deflectable toward the other and biased toward an orientation generally perpendicular to an outside surface of the terminal position assurance member 63. When the terminal position assurance member 63 is installed, as seen in FIG. 4 for example, its outside surface is generally parallel to the portions of the interposer housing 54 that are adjacent to the terminal position assurance member 63. Each latch member can have an indent that engages and matingly accommodates a respective securing ledge 68 (FIG. 6) of the interposer housing 54 when the terminal position assurance member 63 is placed in position.

In an embodiment, each latch member can have a raised portion immediately distal of the indent 67, and each raised portion is shown with a tapered edge 69. During assembly of the terminal position assurance member 63 onto the interposer housing 54 each latch member moves into the signal channel 92 until each latch member, typically at its tapered edge, engages the respective securing ledge 68, which also may be tapered complementary to the taper of the respective tapered edge 69. In this embodiment, each tapered edge of the raised portion engages the respective securing ledge 68 of the interposer housing 54, the ledge 68 deflects the raised portion 61 and thus each latch member until the securing ledge 68 enters the respective indent 67, at which time the parallel relationship between the outside surface and the outside surface of the interposer housing 54 is achieved. In the engaged position, keyed projections on the terminal position assurance member 63 engage with reciprocally shaped keyed notches 49 (FIG. 6) on the interposer housing 54 to secure the terminal position assurance member 63 against forward or backward movement. When terminal position assurance member 63 is snapped into position, the latch members secure the signal module housing 93 in place so as to be in alignment with corresponding signal plugs in this embodiment. It should be noted, however, that other methods of securing a signal module to the interpose housing 54 are also contemplated and the method of securing a signal module (if one is provided) to an interposer housing is not intended be limiting unless otherwise noted.

Figure 12:
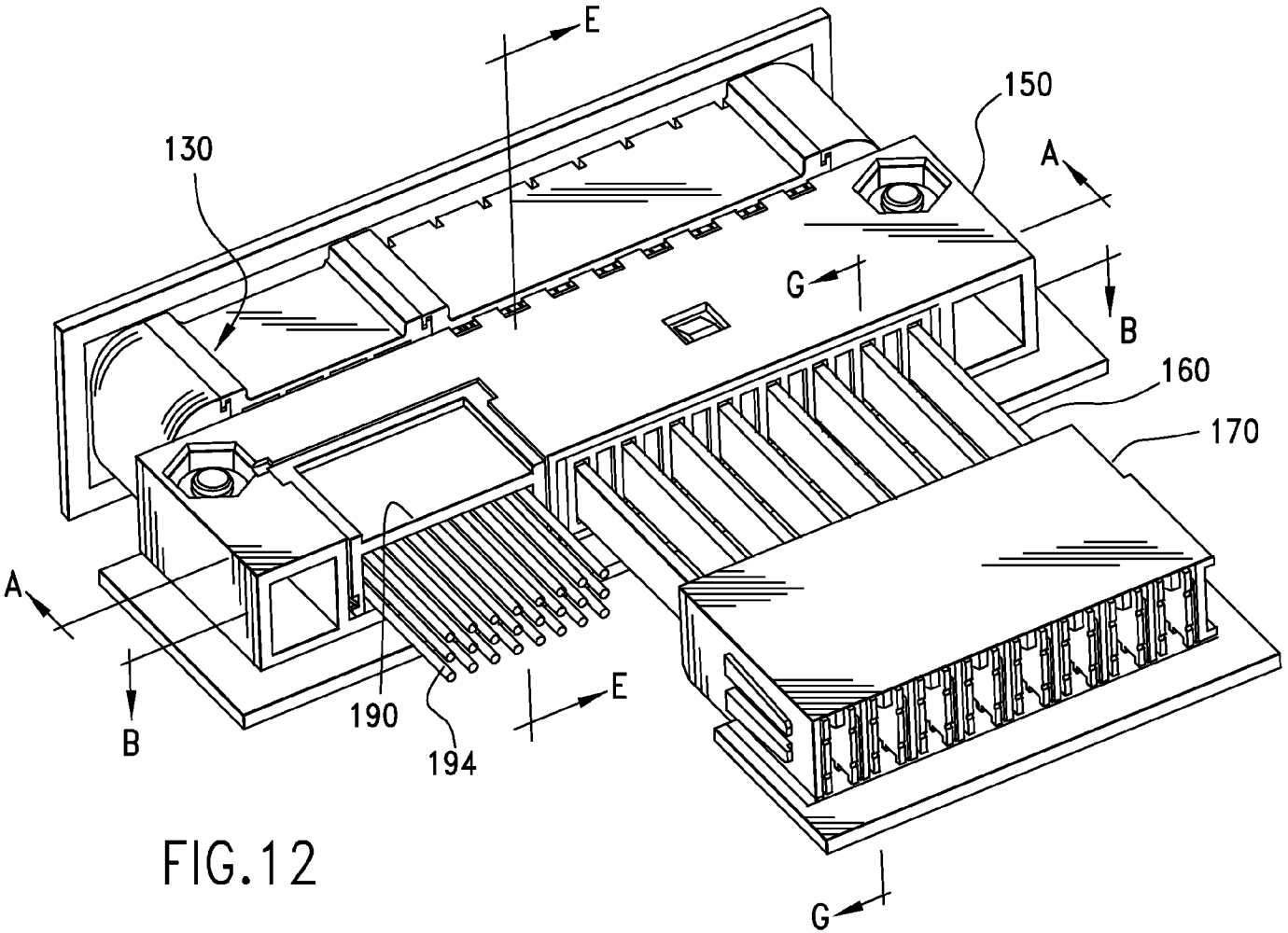
FIG. 12 is a perspective view of an embodiment of an interposer and connector assembly with flexible signal channels truncated.
Figure 12A:
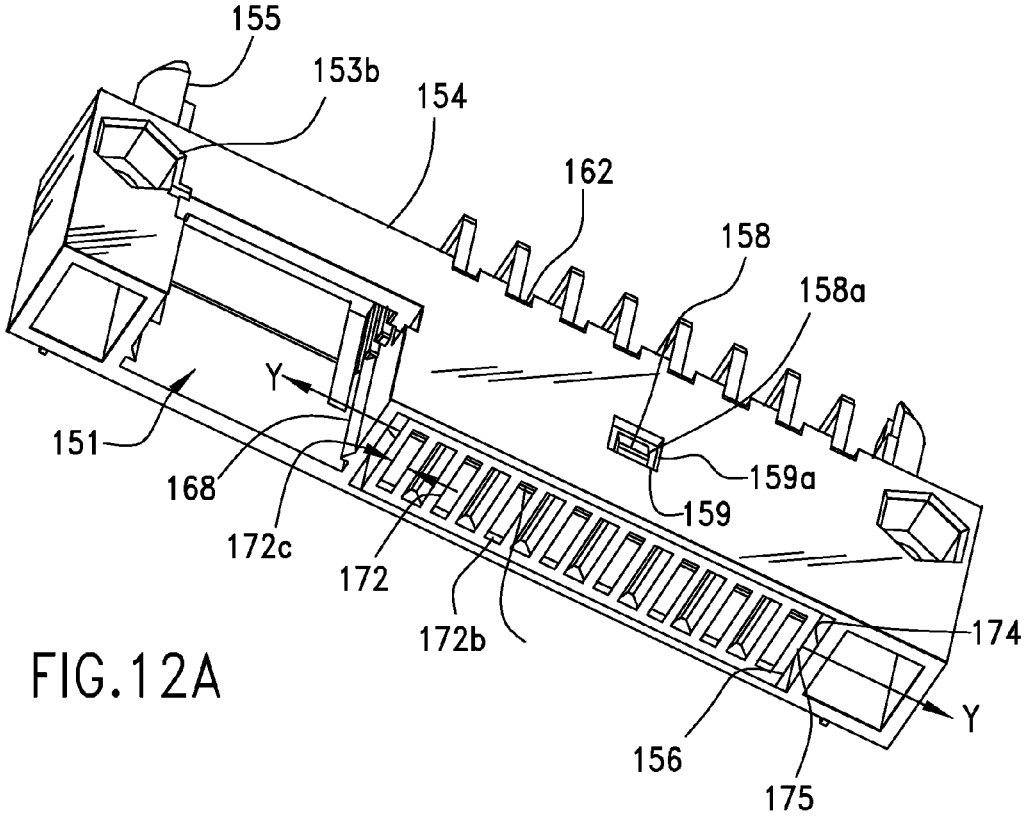
FIG. 12A is a perspective view of the interposer of FIG. 16, with terminals removed.
Figure 12B:
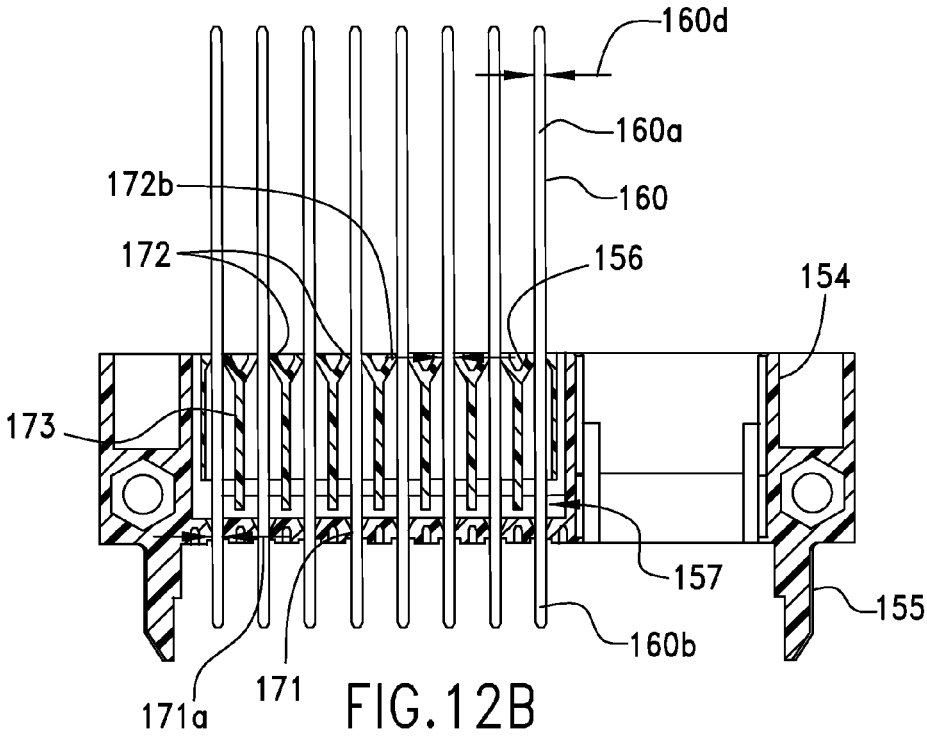
FIG. 12B is a elevated top cross-sectional view of the interpose assembly of FIG. 12 along the line B-B.
Figure 12C:
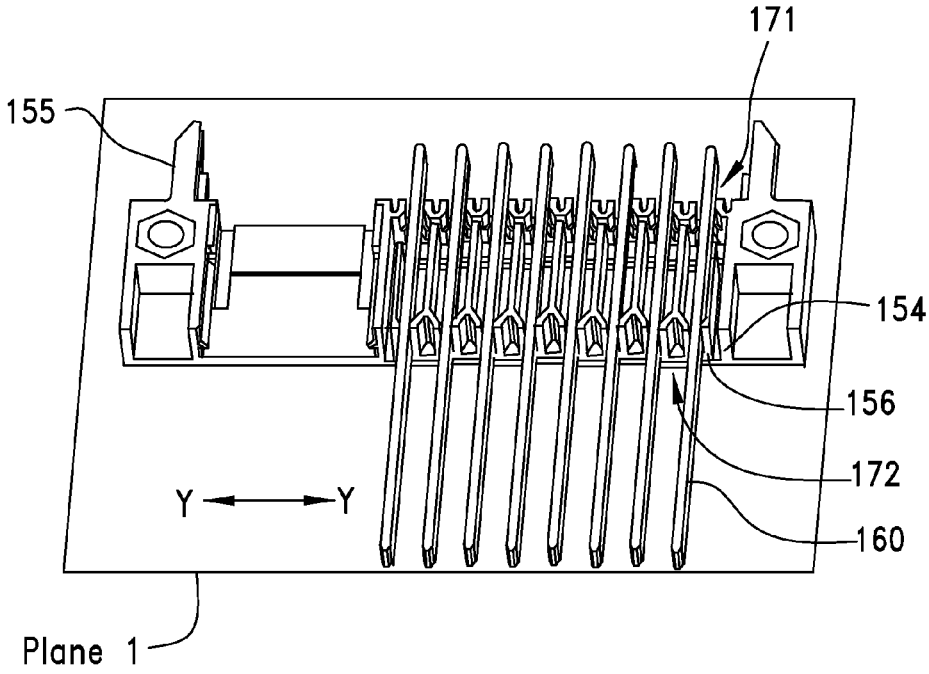
FIG. 12C is a perspective view of the cross-sectioned interposer assembly depicted in FIG. 12B.
Figure 12D:
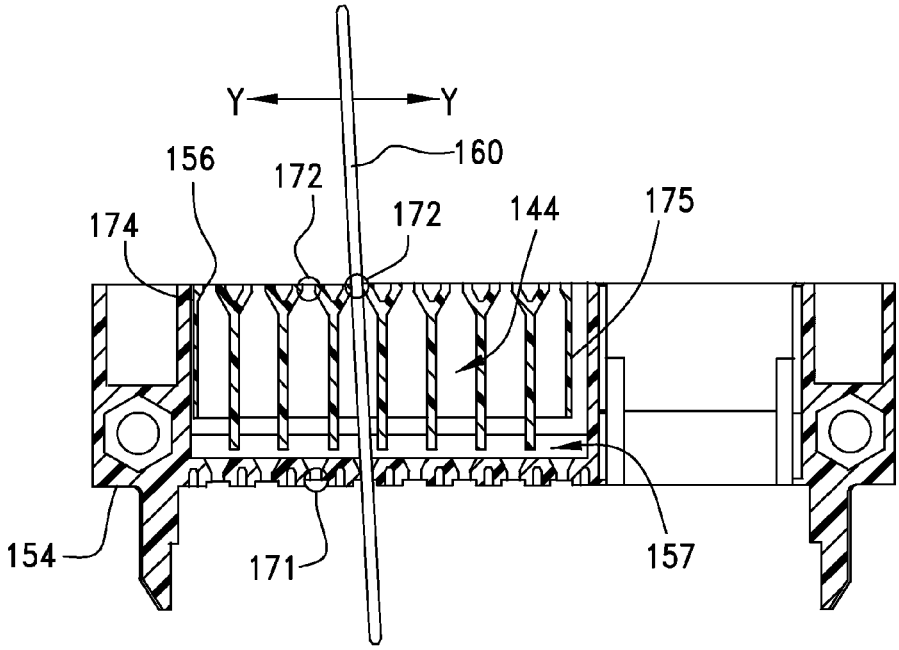
FIG. 12D is a partial cross-sectional view generally as in FIG. 12B, with the terminal housing translated along a Y-axis with respect to the interposer assembly.
Figure 12E:
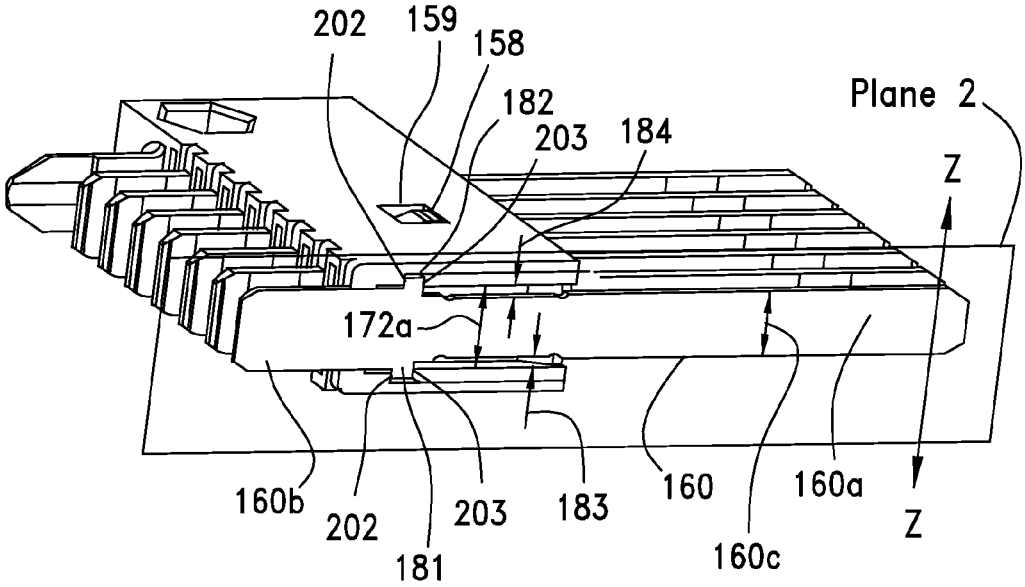
FIG. 12E is a perspective view, partially in cross-section along line E-E of FIG. 12, of the interposer housing and terminal housing.
Figure 12F:
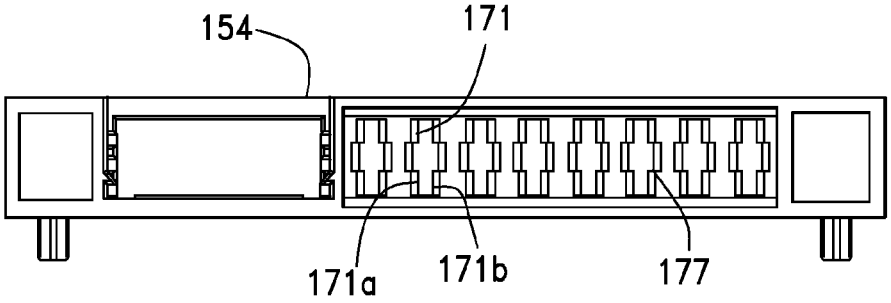
FIG. 12F is an elevated front view of the interposer housing depicted in FIG. 12A.
Figure 12G:
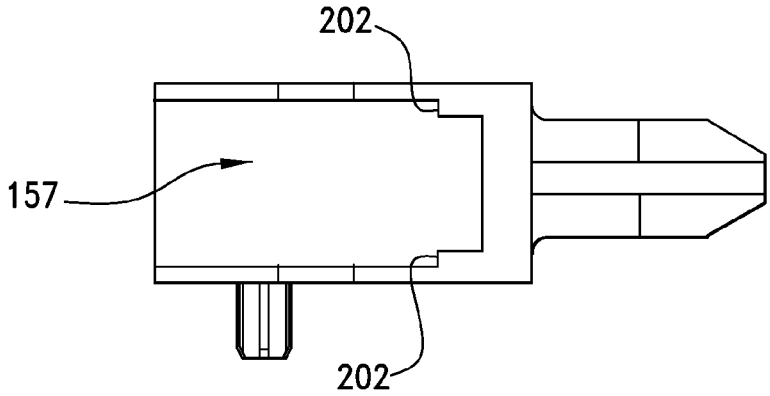
FIG. 12G is a cross-section view of the interposer housing.
Figure 12H:
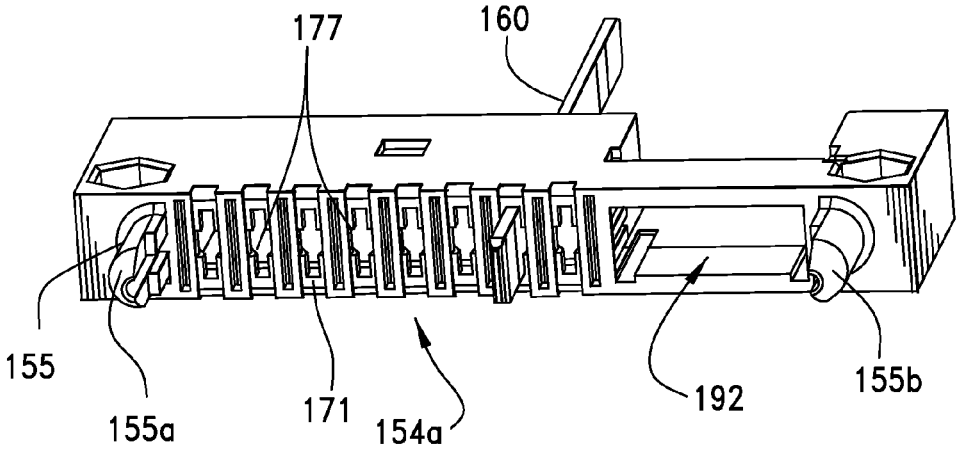
FIG. 12H is an elevation view of the interposer housing of FIG. 12A with a terminal positioned in a slot.
Figure 12I:
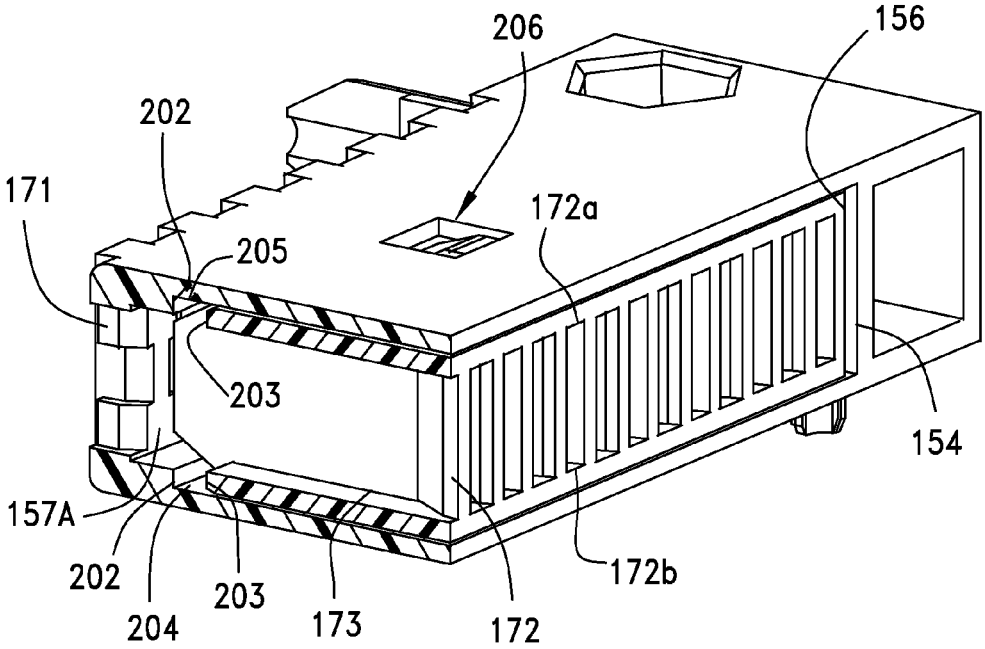
FIG. 12I is a simplified perspective view, partially in cross-section along line E-E of FIG. 12, of an embodiment of the interposer assembly depicted in FIG. 12.

FIGS. 12-12I illustrate details of an embodiment of an interposer assembly 150 configured to couple a connector assembly 130 and a power connector 170. Optional signal module 190 has truncated flexible signal paths 194, which in practice may be terminated to a signal header in a desired manner. As is known, signal paths 194 may join signal channels in two connectors so as to provide an effective signal paths therebetween. If the signal paths are conductive elements, the electrical connection may be to any known electrical device, such as a wire-to-wire connector, a wire-to-board connector, or directly hard wired into electrical signal terminals for example. As illustrated, interposer assembly 150 is in a mated position, with terminals 160 extending from the power connector 170 to the connector assembly 130 via the interposer assembly 150. The signal paths, however, may couple a different connector to the connector assembly 130. Thus, the terminal 160 acts like a beam that resists bending and extends in a relatively straight line while the signal path 194 is relatively free to bend and may follow an undulating path. Therefore, translation of the interposer assembly 150 from the unmated to mated position can be relatively simple for the signal paths, if signal paths are included; the signal paths can simply have sufficient length so they can effectively reach both the mated and unmated position.

Interposer housing 154, which includes bolt holes 153*b*, includes a terminal housing 156 positioned within a terminal housing cavity 157 (FIG. 12G). In addition, air channels 162 may be provided in the interposer housing 154 in order to enhance air flow to the terminals 160. It should be noted that while the depicted embodiment illustrate a terminal housing 156 substantially contained within the interposer housing 154, such a configuration is not required but instead provides a benefit of minimizing movement of an exterior portion of the interposer assembly 150. As can be appreciated, terminal channel 144 has a retaining slot 172, which each include a top edge 172*a*, a bottom edge 172*b*, and a width 172*c*. A latch 158 is position in latch open 159 and secures the terminal housing 156 within the terminal housing channel 157. As depicted, the latch 158 is shorter in the lateral dimension than the latch opening 159. This relative sizing allows the terminal housing 156 to move along a Y-axis. Depending on the size of the latch 158 and the latch opening 159, contact between side 175 of the terminal housing 156 and side 174 of the terminal housing cavity 157 may limit movement along the Y-axis. It should be noted that the pivot slot and the retaining slot are both examples of a securing feature. While a simple slot may be used as a securing feature, other more complex shapes such as openings that include one or more notches and/or projections may also be used.

The latch 158 and the corresponding latch opening 159 are both an example of the retaining feature, which is used with the terminal housing 156. As can be appreciated, a retaining feature such as a latch or latch opening may be positioned on either the top or bottom wall of the interposer housing 154. In an embodiment, more than one positioning feature may be used such as one on both the top wall and bottom wall or with multiple positioning features on the top or bottom wall or some other combination. Furthermore, the relative position of the latch and the latch opening could be switched. An advantage of the depicted configuration, however, is that it is easy to visually determine whether the terminal housing 156 is fully inserted into the terminal housing cavity 157. As depicted in FIG. 12E, which is a view taken along line E-E in FIG. 12, the retaining feature helps secure the terminal housing in the terminal housing cavity 157 so that a tab 181 in the terminal 160 is restrained between a shoulder 202 of the interposer housing 154 and edge 203 of the terminal housing. The retaining feature, however, can allow transverse translation of the terminal housing 156 along the Y-axis.

As can be appreciated from FIGS. 12B-12C, which show a cross section views of an interposer assembly along line B-B in FIG. 12, terminal 160 includes a width 160*d* and is secured in pivot slot 171 (which has a width 171*a*) of the interposer housing 154. The terminal 160 is also secured in retaining slot 172 (which has a width 172*b*) of the terminal housing 156. The width of the slots can be configured to be substantially similar to the width 160*d* so that the terminal 160 has minimal ability to twist in the slots 171, 172 (thus helping to ensure a reliable connection with corresponding terminals in either the power connector 170 or the connector assembly 130). However, because the terminal housing 156 can move relative to interposer housing 154, a first extension 160*a* of the terminal 160 can translate along the Y-axis so as to account for potential variation in the location of the power connector 170 and the connector assembly 130 along the Y-Axis. Thus, the translation of the terminal housing 156 with respect to the interposer housing 154 allows an orientation of the terminal 160 to vary while remaining on plane 1, which as depicted is substantially orthogonal to a mating face 154*a* of the interposer housing 154.

As can be appreciated from FIGS. 12A-12I, therefore, a terminal 160, which can function as a power terminal and is illustrated as having a blade-like shape, may be positioned within each of the channels 144. Each first portion 160*a* extends through and from one of the terminal channels 144. The width 171*a* of the pivot slot 171 may be configured so as to be slightly greater than a width 160*d* of the terminal 160 so that the terminal 160 can move in the Z-directions in the pivot slot 171 but is sufficiently narrow so as to substantially prevent the terminal 160 from moving an appreciable distance in the Y-direction. This allows the terminal 160 to pivot about the pivot slot 171 while maintaining a desirable control over the orientation of the terminal 160 within the slot. As can be appreciated, if a material or plating is chosen that has a relatively low coefficient of friction, the width 171*a* of the pivot slot 171 may more closely match the width 160*d* of the terminal 160 while still allowing the terminal to translate in the Z-direction (e.g., along plane 2).

The ability to translate the terminal 160 in the Z-direction, if desired, can be provided by using opposing tabs 181 and 182 on the terminal 160. When installed within the interposer housing 154, tabs 181, 182 engage respective shoulder 202 and edge 203, thereby preventing movement of each terminal out of the interposer housing 154 through the pivot slot 171. In an embodiment, a width of the tabs 181, 182 relative to a distance between shoulder 202 and edge 203 may be such that it is possible to translate the first extension 160*a* along the Z-axis so that the terminal can move in plane 2. As can be appreciated, a limit on the ability to translate along the Z-axis will be provided by the pivot slot 171 and the retaining slot 172. As depicted, the distance from the tab 181, 182 to the retaining slot 172 is greater, thus a height 172*d* of the retaining slot 172 will tend to limit the amount of translation possible. As can be appreciated from FIG. 12I, the channel 144 can be configured so that it extends substantially the entire distance between face 157*a* of the terminal housing cavity 157 and retaining slot 172. While not required, this extension can help ensure the terminals are substantially isolated from each other (which in certain applications may provide a desirable voltage isolation).

Thus, as can be appreciated, the terminal 160 can translate along a first plane based on relative movement of a terminal housing 156 and an interposer housing 154. This allows the interposer assembly 150 to account for potential variation in the Y-axis between two connectors that the interposer assembly 150 couples together. The terminal 160 can optionally move along a second plane that can be substantially orthogonal to the first plane based on a height of a retention slot and/or sizing of one or more tabs that extend from the terminal.

It should be noted that while the use of a tab on the terminal 160 in combination with the shoulder 202/edge 203 (which is an example of a terminal retention feature) is envisioned as providing a relatively cost effective solution, in an embodiment (not shown) the tab may be replaced by a notch and the terminal housing 156 could include a projection that engaged the notch, thus providing a similar effect. The advantage of the depicted configuration is that assembly is simplified because terminals 160 may be inserted into the terminal housing 156 with relatively little force. However, as can be appreciated, the basic functionality can be provided by other terminal retention features that provide a similar functional result. Furthermore, while the depicted embodiment includes a terminal retention feature on two sides of the terminal 160, in an embodiment a terminal retention feature may be provided on one side of the terminal.

As can be appreciated from FIGS. 12F and 12H, the pivot slot may include an air gap 177 that can act to help facilitate cooling, in combination with air channel 162. Thus, the terminal 160 can be configured to more readily handle higher current levels without requiring a material for the terminal 160 that has extremely low resistive losses.

Figure 11:
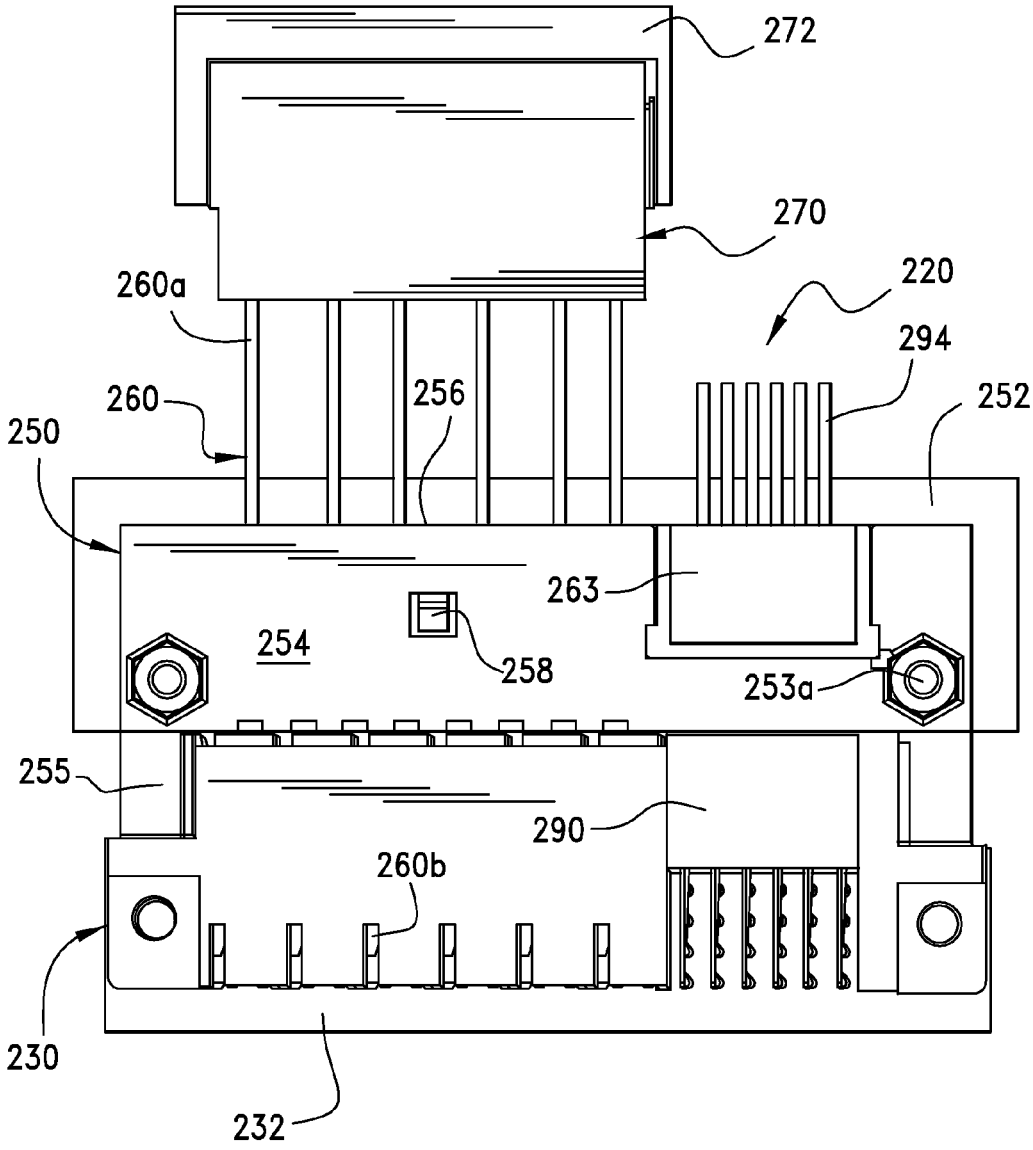
FIG. 11 is a top plan view of another embodiment of an interposer and connector assembly.

FIG. 11 illustrates a top view of an embodiment of an interposer connector assembly generally designated 220. The interposer and connector assembly 220 includes a second connector assembly 230 (e.g., second connector) supported by circuit board 232, an interposer assembly 250 supported by surface 252 and a first connector assembly 270 (e.g., first connector) supported by circuit board 272. The second connector assembly 230 includes signal module 290 and the interposer assembly 250 includes a mating signal module retained by clip 263, which in an embodiment is configured to be slidable mounted to the interposer assembly 250. The signal module is fixed with respect to the interposer assembly 250 and the connector assembly 230 but truncated flexible signal paths 294 extend from the interposer assembly 250 to a corresponding signal header (not shown), which may be positioned as desired. Thus, the depicted interposer assembly 250 can provide substantial architectural flexibility because it can translate (e.g., telescope) from the first connector assembly toward the second connector assembly 230 so that it engages the second connector assembly 230. As depicted, the circuit board 232 and circuit board 272 may be fixed in a spaced apart position and generally parallel to each other as shown. Thus, as can be appreciated, the orientation of the circuit boards that support the first and second connector may vary depending on system architectural requirements and therefore the first and second connector may be a desired combination of vertical, right, angle and/or edge connectors.

It should be further noted that while the first and second connector are depicted as being supported by a circuit board, some other support may be provided. Therefore, the depicted features of the interposer assembly, unless otherwise noted, may be used in a wider range of applications.

Figure 5:
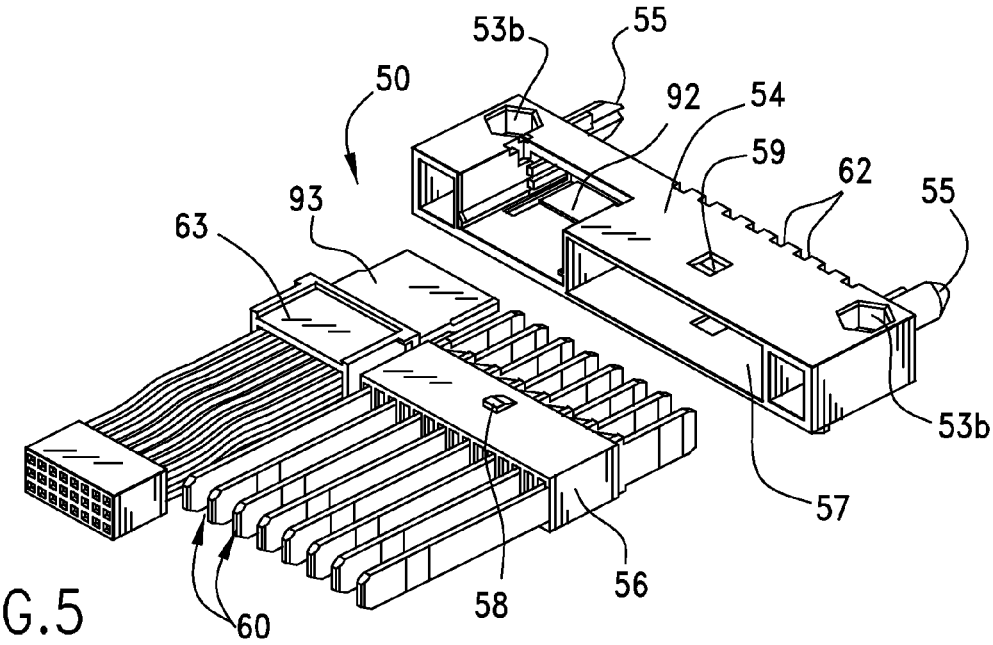
FIG. 5 is an partially exploded perspective view of the interposer assembly of FIG. 4.

Looking again at FIG. 5, it should be noted that in an embodiment the interposer housing 54 and the terminal housing 56 may be configured so that the terminal housing can translate both along the Y-axis (FIG. 12A) and the Z-axis (FIG. 12E). Such a configuration requires that that retaining features to allow movement along both the Y and Z axis, which typically will require additional space. Furthermore, the pivot slot and the retaining slot can also be made wider so that each individual terminal has a greater degree to orientation variability with respect to the other terminals. Both configurations, alone or in combination, would tend to allow for greater variation in the individual terminal(s) in the interposer assembly and therefore care should be sued to ensure to total variation, especially if there is more than one terminal, is such that translation of the interposer assembly can occur without a potential problem in one terminal being out a permissible range of alignment when the interposer assembly is mated to the mating connector. One factor that may help, however, is that in operation the terminals will be extending from a first connector to the interposer assembly. The first connector, in combination with the interposer assembly, will tend to ensure the orientation of the terminals is maintained. An advantage of the configuration depicted in FIGS. 12-12I, however, is that the connector may be kept relatively compact and the ability to adjust ease of translation can be more readily controlled if the interposer housing and the terminal housing have a limited ability to translate with respect to each other (thus minimizing variations in friction forces).

It should also be noted that in certain embodiments a wider pivot slot and retaining slot may be used to provide a substantial portion of the variance for the terminal. If only a wider pivot slot and retaining slot are used (e.g., the terminal housing is not translatable relative to the interposer housing), in an embodiment with multiple terminals it is expected to be beneficial to limit the total amount of orientation variation to something less than could be provided if all the terminal connectors translated along the Y axis in unison so as to ensure the terminals properly engage a mating terminals. Therefore, for configurations with multiple terminals, greater levels of adjustability are expected possible if the terminals move in unison along the Y-axis. It is also noted that in an embodiment where the terminal housing and interposer housing do not translate with respect to each other (because the terminal housing or the retaining feature is sized to prevent such movement), the pivot slot and retaining slot may still be configured with a height that is greater than a height of the terminal so that translation along the Z-axis is possible. Such an interposer connector would still provide some flexibility when coupling two spaced-apart connectors but would not be as suitable for accounting for variation along the Y-axis. Alternatively, translation along the Y-axis could be permitted while translation along the Z-axis could be substantially restrained.

It will be understood that there are numerous modifications of the illustrated embodiments described above which will be readily apparent to one skilled in the art, such as many variations and modifications of the compression connector assembly and/or its components including combinations of features disclosed herein that are individually disclosed or claimed herein, explicitly including additional combinations of such features, or alternatively other types of terminal array connectors. Also, there are many possible variations in the materials and configurations. These modifications and/or combinations fall within the art to which this invention relates and are intended to be within the scope of the claims, which follow. It is noted, as is conventional, the use of a singular element in a claim is intended to cover one or more of such an element.

The invention claimed is:

1. An interposer connector comprising:

a first housing having a first wall with a pivot slot therethrough, the first housing including a cavity, the pivot slot in communication with the cavity;

a second housing translatably positioned in the cavity, the second housing including a retaining slot aligned with the pivot slot; and a terminal extending between the pivot slot and the retaining slot and including a first portion extending through the pivot slot and a second portion extending through the retaining slot, the terminal extending along a first axis, wherein translation of the second housing with respect to the first housing causes a distal end of the second portion to translate in a first direction that is substantially transverse to the first axis.

2. The connector of claim 1, wherein the first portion extends from the pivot slot a first distance and the second portion extends from the retaining slot a second distance, wherein the second distance is at least three times the first distance, wherein in operation the second distance allows the connector to translate from an unmated to a mated position so as to couple together two spaced apart connectors.

3. The connector of claim 1, wherein the first housing includes a shoulder and the second housing includes an edge and the terminal includes a tab, the tab positioned between the shoulder and the edge, wherein the tab is sized to substantially extend between the edge and shoulder.

4. The connector of claim 3, wherein the tab is a first tab and the terminal includes a second tab, the first and second tab extending away from the terminal in opposing directions.

5. The connector of claim 1, wherein first housing includes a first retaining feature and the second housing includes a second retaining feature, the first and second retaining feature configured to cooperate so as to allow the second housing to translate with respect to the first housing in a first direction that is substantially transverse to the longitudinal axis of the terminal and to substantially prevent translation of the second housing in a direction that is substantially perpendicular to the first direction.

6. The connector of claim 5, wherein the terminal in the pivot slot and retaining slot is a first terminal in a first pivot slot and a first retaining slot, the connector further comprising a second terminal in a second pivot slot and a second retaining slot, wherein the translation of the second housing causes distal ends of the first and second terminal to both translate in the first direction substantially the same distance and wherein the first and second terminal are configured to translate separately in the second direction.

7. The connector of claim 6, wherein the retaining slot and the pivot slot are configured to allow the terminal translate up and down.

8. The connector of claim 7, wherein the terminal includes a retaining feature and the terminal is configured to pivot about the retaining feature when translating in the pivot and retaining slot.

9. The connector of claim 1, wherein the terminal in the pivot slot and retaining slot is a first terminal in a first pivot slot and a first retaining slot, the connector further comprising a second terminal in a second pivot slot and a second retaining slot, wherein the translation of the second housing causes distal ends of the first and second terminal to both translate in the first direction substantially the same distance and wherein the first and second terminal are configured to translate separately in the second direction.

10. The connector of claim 1, further comprising an alignment guide configured to bring the first housing into alignment with a corresponding connector, wherein in operation the interposer assembly is configured to translate from an unmated position to a mated position and the alignment guide helps ensure alignment between the interposer assembly and the corresponding connector is maintained as the interposer assembly translates.

11. The connector of claim 1, wherein the first wall includes an opening, the connector further comprising a third housing positioned in the opening in the first wall, the third housing including a signal terminal, wherein the signal terminal includes a contact portion and the signal terminal is coupled to a flexible conductor.

12. The connector of claim 1, wherein the terminal is blade shaped.

13. The connector of claim 12, wherein the terminal in the pivot slot and retaining slot is a first terminal in a first pivot slot and a first retaining slot, the connector further comprising a second terminal in a second pivot slot and a second retaining slot, wherein the translation of the second housing causes distal ends of the first and second terminal to both translate in the first direction substantially the same distance, wherein the first and second terminal are configured to translate separately in a second direction.

14. An interposer connector comprising:

a housing assembly with a first face and a second face opposite the first face, the housing assembly including a pivot slot and a channel with a first securing feature, the channel being translatable with respect to the pivot slot; and a terminal, the terminal extending through the pivot slot and out the first face and the terminal extending through the channel and out the second face, wherein translation of the channel causes the terminal to pivot about the pivot slot in a first plane.

15. The connector of claim 14, wherein the terminal includes a second retaining feature, the second retaining feature positioned between the pivot slot and the first retaining feature, wherein the pivot slot and the first retaining feature are configured to allow the terminal to rotate about the second retaining feature in a second plane, the second plane being substantially perpendicular to first plane.

16. The connector of claim 14, wherein the terminal extends out of the first face a first distance and extends out of the second face a second distance, wherein the second distance is at least three times the first distance, wherein in operation the second distance allows the connector to translate from an unmated to a mated position so as to couple together two spaced apart connectors.

17. The connector of claim 14, wherein the terminal is a power terminal that extends out the second face a distance of about four times the distance the power terminal extends out the first face.

18. The connector of claim 14, wherein the terminal has a thin, rectangular shape.

19. An interposer connector comprising:

a first housing including a plurality of pivot slots on a first face, the first housing including a cavity with a first wall, the first wall including a first positioning feature;

a second housing with a first edge positioned in cavity, the second housing including a second position feature for engaging the first positioning feature and further including a plurality of channels aligned with the plurality of pivot slots, each of the plurality of channels including a securing feature, wherein the cavity is sized so as to allow the second housing to translate within the cavity, the translation at least partially limited by the first and second positioning feature; and a plurality of blade terminals positioned in the plurality of pivot slots and the plurality of channels so that each of the plurality of blade terminals are constrained from transverse movement by one of the corresponding pivot slot and securing feature, each of the plurality of blade terminals including a retaining feature configured to retain the blade terminal in the housing.

20. The connector of claim 19, wherein the first housing includes an opening and a signal module with a plurality of signal terminals positioned in the opening, the each of the plurality of signal terminals coupled to a flexible conductor.

21. The connector of claim 20, further including a generally U-shaped terminal position assurance member configured to slidably engage and secure the signal module in the opening.

22. The connector of claim 21, wherein the plurality of blade terminals are configured to pivot about the retaining feature, wherein translation of the second housing causes each of the plurality of blade terminals to translate substantially the same distance along a first plane and each of plurality of blade terminals is configured to translate separately along a second plane that is substantially perpendicular to the first plane.

* * * * *